US009735495B2

(12) United States Patent
Gross

(10) Patent No.: US 9,735,495 B2
(45) Date of Patent: Aug. 15, 2017

(54) ELECTRICAL CABLE ASSEMBLY

(71) Applicant: FCI AMERICAS TECHNOLOGY LLC, Carson City, NV (US)

(72) Inventor: Charles M. Gross, Etters, PA (US)

(73) Assignee: FCI Americas Technology LLC, Carson City, NV (US)

( * ) Notice: Subject to any disclaimer, the term of this patent is extended or adjusted under 35 U.S.C. 154(b) by 0 days.

(21) Appl. No.: 14/779,368

(22) PCT Filed: Mar. 21, 2014

(86) PCT No.: PCT/US2014/031448
§ 371 (c)(1),
(2) Date: Sep. 23, 2015

(87) PCT Pub. No.: WO2014/160610
PCT Pub. Date: Oct. 2, 2014

(65) Prior Publication Data

US 2016/0049746 A1 Feb. 18, 2016

Related U.S. Application Data

(60) Provisional application No. 61/805,047, filed on Mar. 25, 2013.

(51) Int. Cl.
*H01R 13/52* (2006.01)
*H01R 13/502* (2006.01)
(Continued)

(52) U.S. Cl.
CPC ..... *H01R 13/502* (2013.01); *H01R 13/5208* (2013.01); *H01R 13/6461* (2013.01); *H01R 9/03* (2013.01); *H01R 12/77* (2013.01)

(58) Field of Classification Search
CPC ..... H01R 9/03; H01R 12/77; H01R 13/6461; H01R 13/5208; H01R 13/502
(Continued)

(56) References Cited

U.S. PATENT DOCUMENTS 4,397,516 A 8/1983 Koren et al.
5,281,762 A * 1/1994 Long ..... H01R 9/0515 174/117 F
(Continued)

FOREIGN PATENT DOCUMENTS

CN 201781115 U 3/2011
JP 2003109708 4/2003
(Continued)

OTHER PUBLICATIONS

Extended European Search for European Application No. 14773438.8 dated Oct. 12, 2016.
(Continued)

*Primary Examiner* — Abdullah Riyami
*Assistant Examiner* — Nelson R Burgos-Guntin
(74) *Attorney, Agent, or Firm* — Wolf, Greenfield & Sacks, P.C.

(57) ABSTRACT

An interposer is configured to receive signal conductors of a cable, and align the received signal conductors with contact pads of an electrical connector. The interposer can be dielectric, or electrically insulative, so as to reduce electrical signal reflections and help to prevent electrical shorting between the signal conductors.

20 Claims, 7 Drawing Sheets

(51) Int. Cl.
*H01R 13/6461* (2011.01)
*H01R 9/03* (2006.01)
*H01R 12/77* (2011.01)

(58) Field of Classification Search
USPC ..... 439/660, 492–499
See application file for complete search history.

(56) References Cited

U.S. PATENT DOCUMENTS 5,453,026 A * 9/1995 Ikegami ..... H01R 23/688 439/579
5,495,075 A 2/1996 Jonckheere et al.
5,580,264 A * 12/1996 Aoyama ..... H01R 13/5208 439/275
6,156,975 A 12/2000 Roose
6,380,485 B1 * 4/2002 Beaman ..... H01R 9/035 174/88 R
6,648,676 B1 * 11/2003 Lee ..... H01R 43/24 439/499
6,896,549 B2 * 5/2005 Feuerreiter ..... H01R 24/54 439/579
6,896,556 B1 * 5/2005 Wu ..... H01R 31/06 439/638
8,696,378 B2 * 4/2014 Behziz ..... H01R 12/53 439/497
2003/0186580 A1 10/2003 Dambach et al.
2004/0002262 A1 1/2004 Murayama et al.
2004/0185708 A1 * 9/2004 Kuwahara ..... H01R 4/023 439/497
2011/0059643 A1 3/2011 Kuwahara et al.
2012/0064779 A1 3/2012 Wu
2013/0270000 A1 10/2013 Buck et al.
2014/0030905 A1 * 1/2014 Phillips ..... H01R 13/506 439/345
2014/0154927 A1 * 6/2014 Nonen ..... H01R 9/037 439/660
2016/0018606 A1 * 1/2016 Xue ..... G02B 6/38 385/76
2016/0049746 A1 * 2/2016 Gross ..... H01R 13/5208 439/660

FOREIGN PATENT DOCUMENTS

JP 2004031257 1/2004
JP 2004-071404 A 3/2004
JP 2006260850 9/2006
JP 2013-021600 A 1/2013

OTHER PUBLICATIONS

International Search Report and Written Opinion for International Application No. PCT/US2014/031448 dated Jul. 10, 2014.
International Preliminary Report on Patentability for International Application No. PCT/US2014/031448 dated Oct. 8, 2015.
Chinese Office Action for Chinese Application No. 201480017853.4 dated Feb. 4, 2017.

* cited by examiner

ELECTRICAL CABLE ASSEMBLY

CROSS-REFERENCE TO RELATED APPLICATIONS

This application is the National Stage of International Application No. PCT/US2014/031448, filed Mar. 21, 2014, which claims the benefit of U.S. application No. 61/805,047, filed Mar. 25, 2013, the disclosures of which are incorporated herein by reference in their entireties.

BACKGROUND

Electrical cable connectors typically include a plurality of signal contacts and ground contacts, and respective electrical cables having cable conductors that are placed in electrical communication with respective ones of the signal contacts. The signal contacts and ground contacts are configured to mate with complementary contacts of a complementary electrical connector.

SUMMARY

In accordance with one embodiment, an interposer for an electrical connector can include an electrically insulative body that defines only a pair of holes, wherein each of the pair of holes is configured to receive a respective one of a pair of differential signal conductors.

DESCRIPTION OF THE DRAWINGS

The foregoing summary, as well as the following detailed description of an example embodiment of the application, will be better understood when read in conjunction with the appended drawings, in which there is shown in the drawings example embodiments for the purposes of illustration. It should be understood, however, that the application is not limited to the precise arrangements and instrumentalities shown. In the drawings.

DETAILED DESCRIPTION

Figure 1:
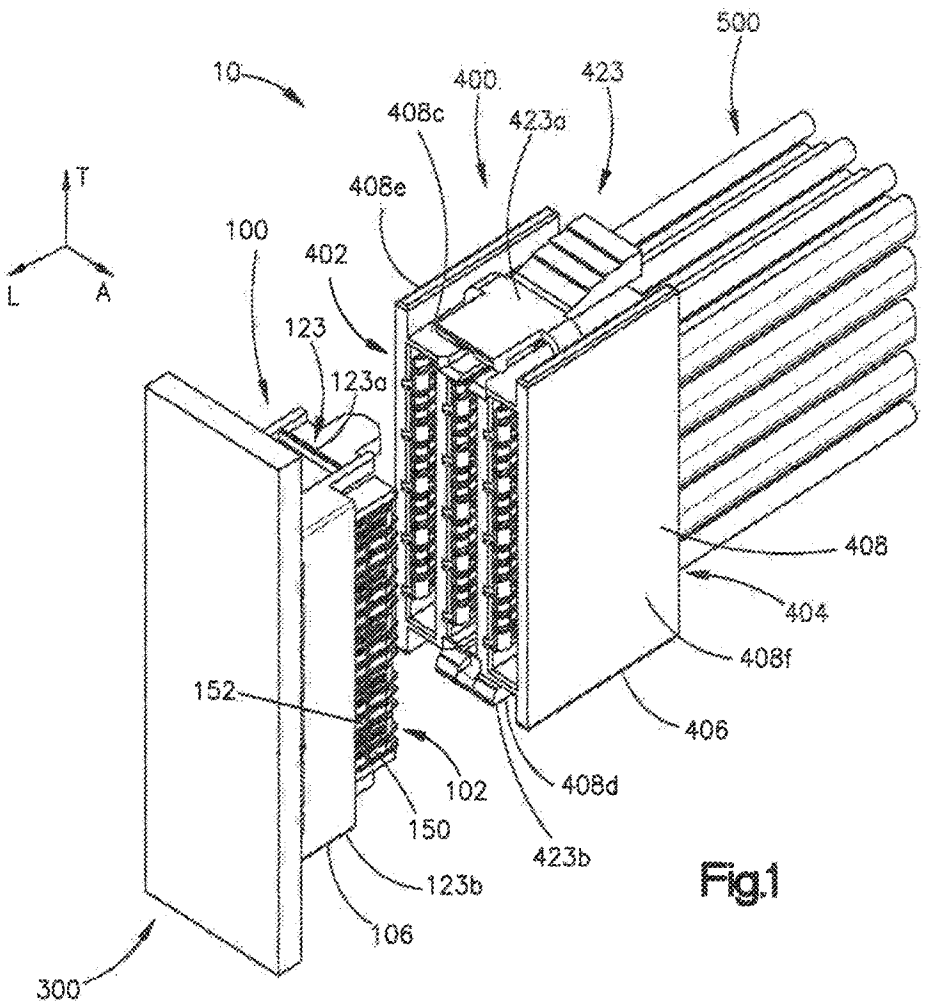
FIG. 1 is a perspective view of an electrical cable connector system constructed in accordance with one embodiment, including an electrical cable connector assembly and a second electrical connector configured to be mated to each other.

Referring initially to FIG. 1, an electrical cable connector system 10 can include an electrical cable assembly 200, which can include a first electrical connector 400, which can be an electrical cable connector, and a plurality of cables 500, and a second or complementary electrical connector 100 configured to be mated with the first electrical connector 400, and an electrical component such as a substrate 300. The first electrical connector 400 can be configured to be mounted to the plurality of cables 500, thereby defining the electrical cable assembly 200, no as to place the first electrical connector 400 in electrical communication with the cables 500. The second electrical connector 100 can be configured to be mounted to the substrate 300 so as to place the second electrical connector 200 in electrical communication with the substrate 300. The substrate 300 can be configured as a printed circuit board. For instance, the substrate 300 can be configured as a backplane, or alternatively can be configured as a midplane, daughter card, or any suitable alternative electrical component. The first and second electrical connectors 400 and 100 are configured to be mated with each other along a mating direction so as to place the first electrical connector 400 in electrical communication with the second electrical connector 100. The mating direction can, for instance, define a longitudinal direction L. Accordingly, the first and second electrical connectors 400 and 100 can be mated to one another so as to place the substrate 300 in electrical communication with the cables 500.

Figure 2A:
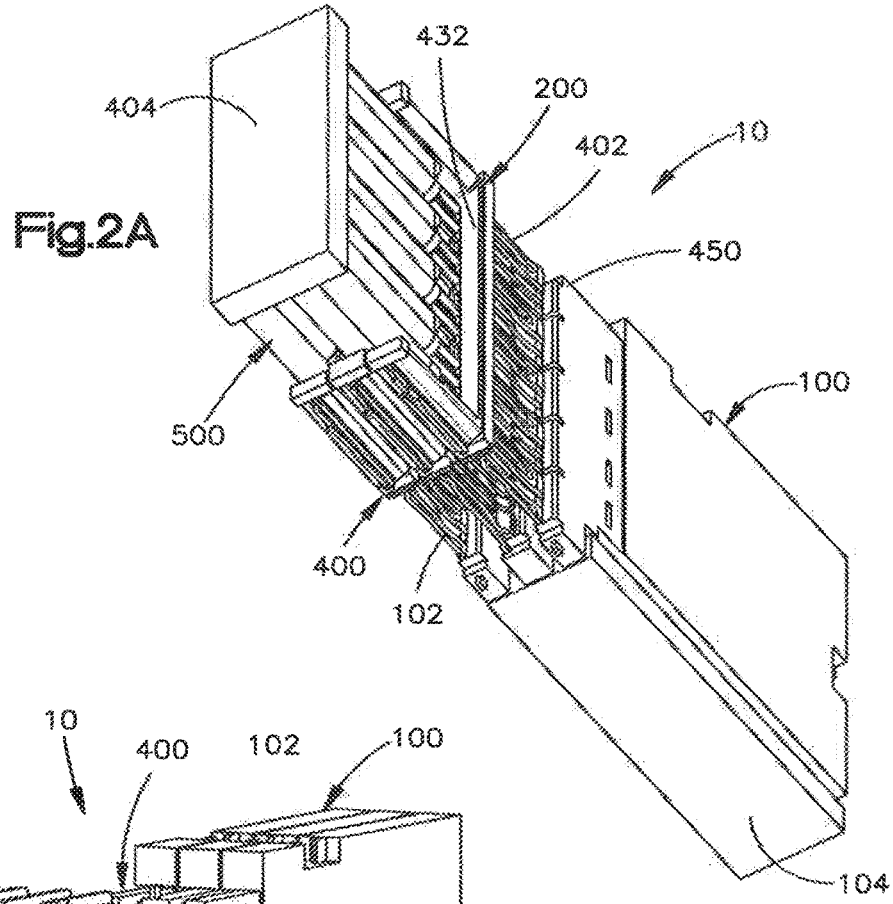
FIG. 2A is a perspective view of the electrical cable connector system as illustrated in FIG. 1, but showing the second electrical connector constructed in accordance with an alternative embodiment.
Figure 2B:
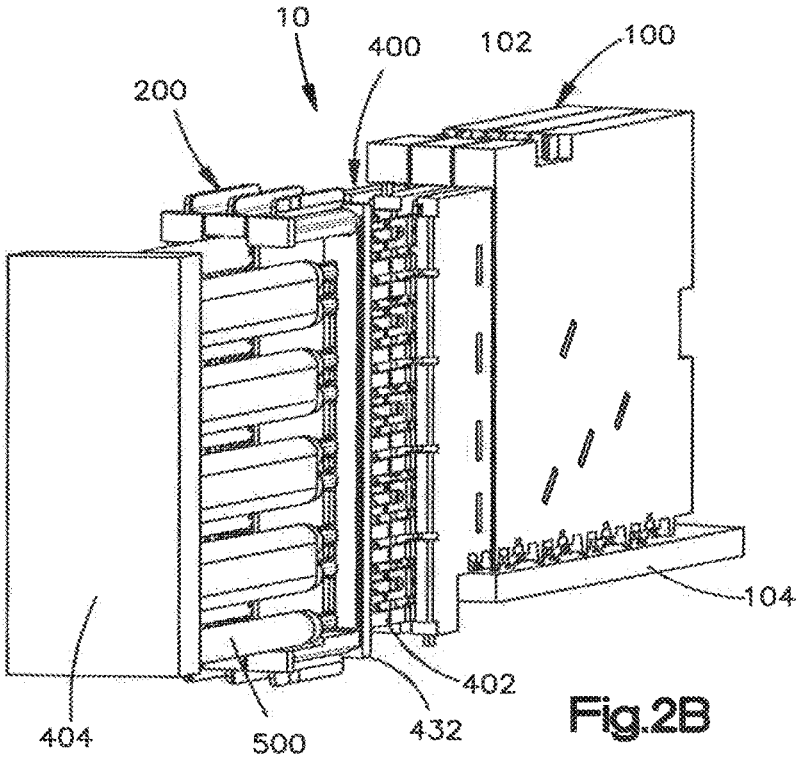
FIG. 2B is another perspective view of the electrical cable connector system illustrated in FIG. 2A.

The first electrical connector 400 can be constructed as a vertical electrical connector that defines a mating interface 402 and a mounting interface 404 that is oriented substantially parallel to the mating interface 402. Alternatively, the first electrical connector 400 can be configured as a right-angle electrical connector whereby the mating interface 402 is oriented substantially perpendicular with respect to the mounting interface 404. In accordance with the embodiment illustrated in FIG. 1, the second electrical connector 100 can be constructed as a vertical electrical connector that defines a mating interface 102 and a mounting interface 104 that is oriented substantially parallel to the mating interface 102. Alternatively, as illustrated in FIGS. 2A-B, the second electrical connector 100 can be configured as a right-angle electrical connector whereby the mating interface 102 is oriented substantially perpendicular with respect to the mounting interface 104. The first electrical connector 400 is configured to mate with the mating interface 102 of the second electrical connector 100 at its mating interface 402. Similarly, the second electrical connector 100 is configured to mate with the mating interface 402 of the first electrical connector 400 at its mating interface 102.

Figure 3:
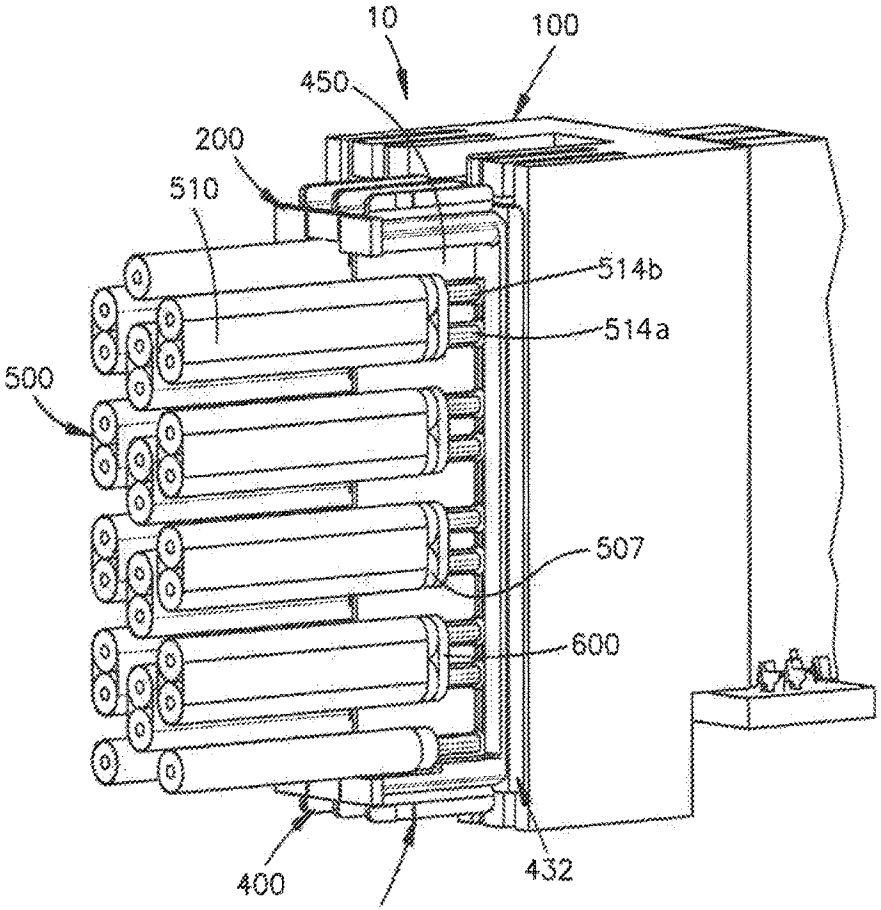
FIG. 3 is a perspective view of the electrical cable system illustrated in FIGS. 2A-B, but showing a portion of the housing of the cable connector assembly removed.

Referring again to FIGS. 1-2B, the electrical cable assembly 200 includes the first electrical connector 400 mounted to the plurality of cables 500. The first electrical connector 400 can include a dielectric, or electrically insulative connector housing 406 and a plurality of electrical contacts 450 that are supported by the connector housing 406. The plurality of electrical contacts 450 can include respective pluralities of signal contacts 452 and at least one ground contact 454. Referring to FIG. 3, the first electrical connector 400 can include a plurality of leadframe assemblies 430 that are supported by the connector housing 406, and spaced from each other along a lateral direction A that is substantially perpendicular with respect to the longitudinal direction L.

Figure 4A:
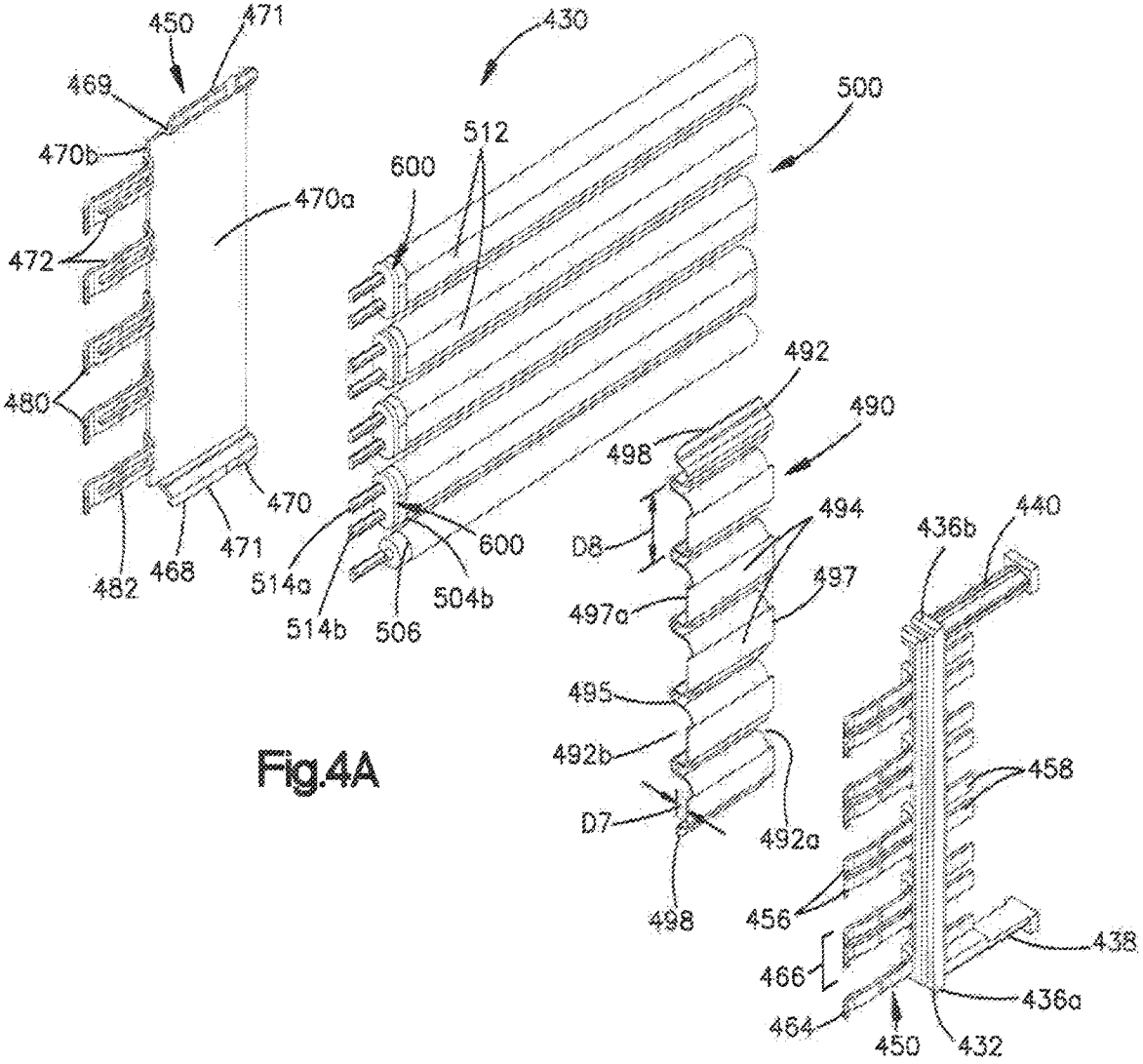
FIG. 4A is an exploded perspective view of a leadframe assembly of the cable connector assembly illustrated in FIGS. 1 and 2A-B.
Figure 4C:
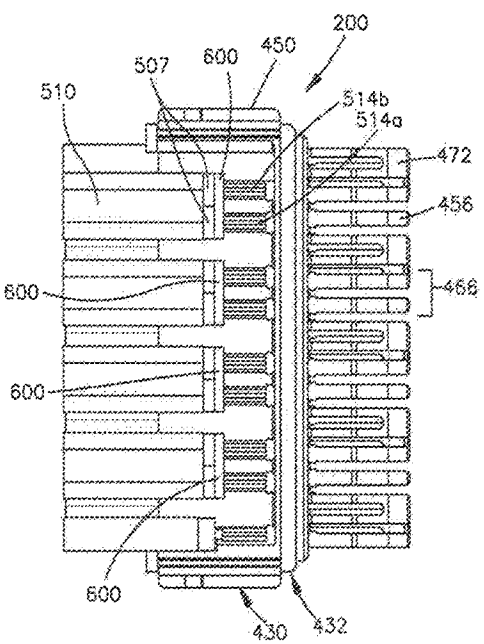
FIG. 4C is a side elevation view of the partially assembled leadframe assembly illustrated in FIG. 4B.
Figure 4B:
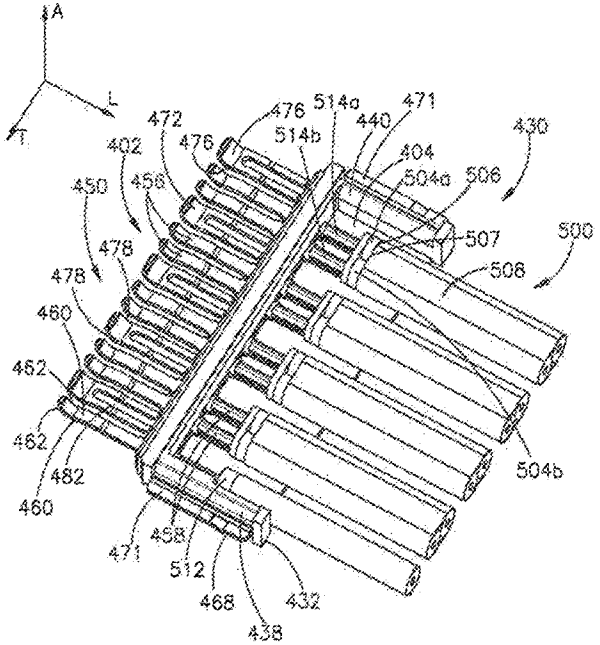
FIG. 4B is a perspective view of the leadframe assembly illustrated in FIG. 3, shown in a partially assembled configuration.

Referring now to FIGS. 4A-4C, each leadframe assembly 430 can include a dielectric, or electrically insulative, leadframe housing 432, and a plurality of electrical contacts 450 that are supported by the leadframe housing 432. Each leadframe assembly 430 can further include a compression shield 490 that is configured to locate ends of each of the cables 500 of the respective leadframe assembly 430 with respect to the ends of the other ones of the cables of the respective leadframe assembly 430, as is described in more detail below. In accordance with the illustrated embodiment, each leadframe assembly 430 includes a plurality of signal contacts 452 that are supported by the leadframe housing 432 and a ground contact 454 configured as an electrically conductive ground plate 468. The signal contacts 452 can be overmolded by the dielectric leadframe housing 432 such that the leadframe assemblies 430 are configured as insert molded leadframe assemblies (IMLAs), or can be stitched into or otherwise supported by the leadframe housing 432. The ground plate 468 can be attached to the dielectric housing 432. The first and second electrical connectors 100 and 400 can be configured to mate with and unmate from each other the mating direction M. Each of the signal contacts 452 can include a mating end 456 and a mounting end 458. The mating ends 456 can be spaced from each other along a column direction or linear array, which can be defined by a transverse direction T that is substantially perpendicular with respect to both the longitudinal direction L and the lateral direction A. The mounting ends 458 can likewise be spaced from each other along the column direction which can be defined by the transverse direction T when the first electrical connector 400 is a vertical connector, or the longitudinal direction L when the first electrical connector 400 is a right-angle connector.

The leadframe housing 432 includes a housing body 434 that defines a front wall 436 that is elongate along the transverse direction T, and defines opposed first and second ends 436*a* and 436*b* that are spaced apart from each other along the lateral direction A. The front wall 436 can be configured to at least partially support the signal contacts 452. For example, in accordance with the illustrated embodiment, the signal contacts are supported by the front wall 436 such that the signal contacts 452 are disposed between the first and second ends 436*a* and 436*b*. The mating ends 456 can extend forward with respect to the front wall 436 along the longitudinal direction L, which can be the mating direction, and the mounting ends 458 can extend rearward with respect to the front wall 436 along the longitudinal direction L, which can be opposite the mating direction. The leadframe housing 432 can further define first and second attachment arm 438 and 440, respectively, that extend rearward from the front wall 436 along the longitudinal direction L. The first and second attachment arm 438 and 440 can define attachment locations for the ground plate 468, the compression shield 490, or each of the round plate 468 and the compression shield 490, as described in more detail below.

Figure 5A:
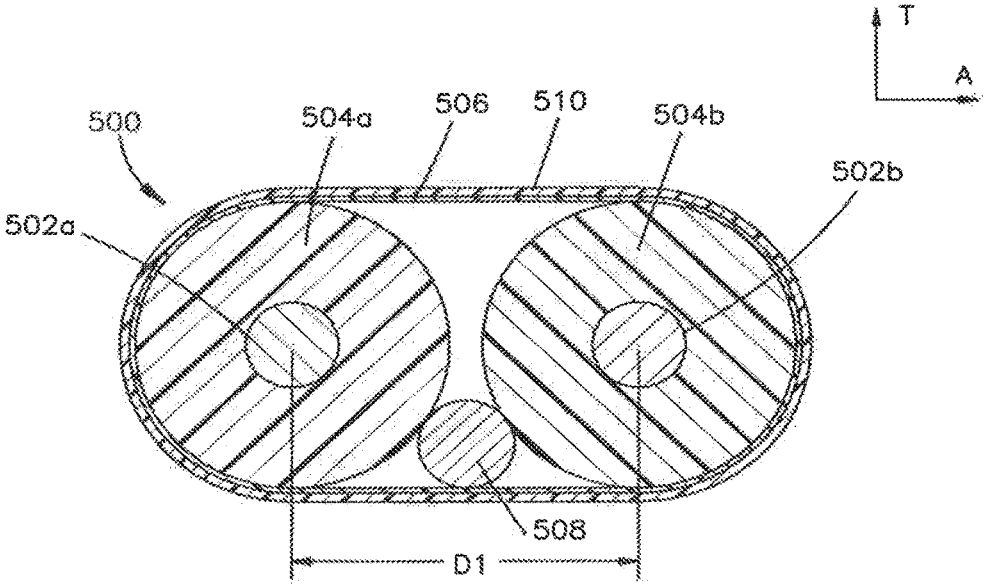
FIG. 5A is a sectional end elevation view of one of the cables of the electrical cable connector assembly.

Referring now to FIG. 5A, each of the plurality of cables 500 can include at least one electrical signal conductor such as a pair of signal conductors including a first signal conductor 502*a* and a second signal conductor 502*b*. The first and second signal conductors 502*a* and 502*b* can define a differential signal pair, or can define single-ended electrical signal conductors as desired. Each of the plurality of cables 500 can further include at least one electrically insulative layer that surrounds the at least one signal conductor. For instance, each of the plurality of cables 500 can include a first inner electrically insulative layer 504*a* that surrounds the first signal conductor 502*a* and a second inner electrically insulative layer 504*b* that surrounds the second signal conductor 502*b*. The insulative layers 504*a-b* surround the respective signal conductors 502*a-b* with respect to a plane that extends along a direction normal to a direction along which the signal conductors 502*a-b* are elongate. The first and second electrically insulative layers 504*a* and 504*b* can reduce the crosstalk imparted by one of the first and second signal conductors 502*a* and 502*b* of the cable 500 to the other of the first and second signal conductors 502*a* and 502*b* of the cable 500. As illustrated in FIGS. 4A-C, an outermost one of the cables 500 of each of the leadframe assemblies 430 can include a single conductor 502, which can be a widow conductor that can be configured to be a single-ended signal conductor, a low speed or low frequency signal conductor, a power conductor, a ground conductor, or some other utility conductor.

Referring again to FIG. 5A, each of the cables 500 can further include at least one drain wire 508. For instance, each of the electrical cables 500 can include an electrically conductive ground jacket 506, which can be configured as an electrically conductive foil, that surrounds both of the respective electrically insulative layers 504*a* and 504*b* of the cable 500. The ground jacket 506 can be connected to a respective ground plane of a complementary electrical component to which the cable 500 is mounted. For example, in accordance with the illustrated embodiment, the around jacket 506 of each of the plurality of cables 500 can be placed into electrical communication with the ground plate 468. For instance, in accordance with certain embodiments, the ground jacket 506 can carry the drain wire 508 that is configured as a ground conductor that can be supported by the ground jacket 506. The drain wire 508 can extend out from the ground jacket 506 and can be configured to attach to a ground contact of the first electrical connector 400, either in the form of the ground plate 468, or an individual electrical ground contact that includes only a single ground mating end. The ground jackets 506 can be in electrical communication with each other, and the drain wire 508 extends out from either or both of the ground jackets 506.

Each of the plurality of cables 500 can further include an exterior insulation layer 510 that is dielectric and electrically insulative, and surrounds the respective ground jacket 506 and the drain wire 508. The exterior insulation layer 510 can reduce the crosstalk imparted by the respective cable 500 to others of the plurality of cables 500. The insulative layers 504*a*-504*b* and the exterior insulation layer 510 can be constructed of any suitable dielectric material, such as plastic. The signal conductors 502*a* and 502*b*, and the drain wire 508, can be constructed of any suitable electrically conductive material, such as copper. In accordance with the illustrated embodiment, the center of each of the first and second signal conductors 502*a* and 502*b* can be spaced from the center of the other of the first and second signal conductors 502*a* and 502*b* a first distance D1.

Figure 5B:
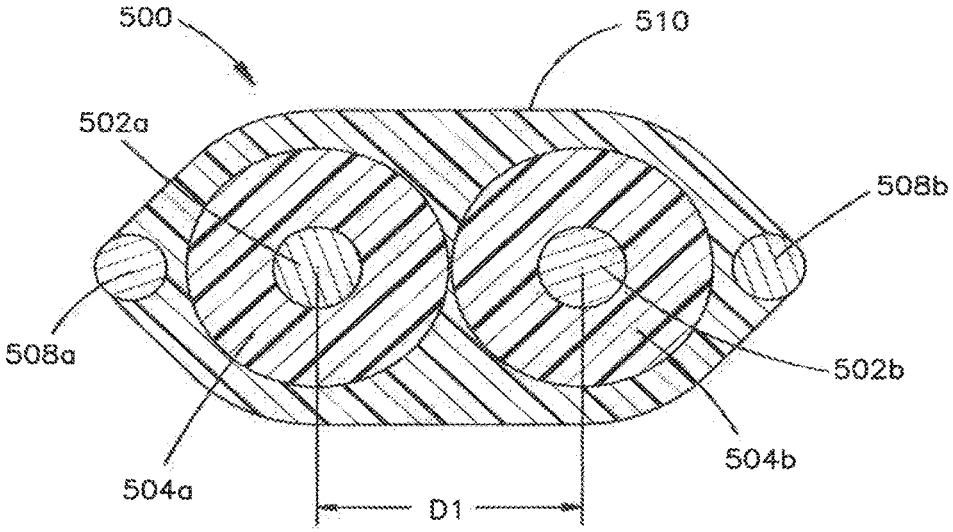
FIG. 5B is a sectional end elevation view of one of the cables of the electrical cable connector assembly in accordance with another embodiment.

It should be appreciated that the electrical cables 500 can be constructed in any manner as desired. For instance, the electrical cables 500 can include a single drain wire 508 as described above with respect to FIG. 5A. Alternatively, as illustrated in FIG. 5B, the electrical cables 500 can include first and second drain wires 508*a* and 508*b*. With reference to FIG. 5B, each of the plurality of cables 500 can further include an exterior insulation layer 510 that is dielectric and electrically insulative, and surrounds the first and second electrically insulative layers 504*a* and 504*b*. Each of the first and second drain wires 508*a* and 508*b* can be supported by the exterior insulation layer 510 at a location such that each of the first and second signal conductors 502*a* and 502*b* is disposed between the first and second drain wires 508*a* and 508*b* with respect to the lateral direction A. Further, each of the first and second electrically insulative layers 504*a* and 504*b* can be disposed between the first and second drain wires 508*a* and 508*b* with respect to the lateral direction A. As described above with respect to FIG. 5A, the center of each of the first and second signal conductors 502*a* and 502*b* can be spaced from the center of the other of the first and second signal conductors 502*a* and 502*b* a first distance D1. The first distance D1 when the electrical cable 500 includes first and second drain wires 508*a* and 508*b* as illustrated in FIG. 5B can be greater than, less than, or equal to the first distance D1 when the electrical cable 500 includes a single drain wire 508 as illustrated in FIG. 5A.

Referring now to FIGS. 4A-4C in particular, each of the plurality of cables 500 can have an end 512 that can be configured to be mounted or otherwise attached to the leadframe assembly 530 so as to place the cable 500 in electrical communication with the leadframe assembly 530. For example, the end 512 of each cable 500 can be configured such that the first and second signal conductors 502*a* and 502*b* define respective end portions 514*a* and 514*b* that are exposed. For instance, in accordance with one embodiment, the end portions 514*a* and 514*b* can extend out with respect to the respective first and second electrically insulative layers 504*a* and 504*b*. Further, the end portions 514*a* and 514*b* can extend out with respect to the respective outer electrically insulative layer 510. Further, the end portions 514*a* and 514*b* can extend out with respect to the respective electrically conductive ground jacket 506. For example, respective portions of the inner and exterior insulative layers 504*a-b* and 510 and the ground jacket 506 of each cable 500 can be removed from the respective signal carrying conductors 502 at the end 512 so as to expose the exposed end portions 514*a* and 514*b* of the respective first and second signal conductors 502*a* and 502*b*. The respective portions of the inner and exterior insulative layers 504*a-b* and 510 and the ground jacket 506 of each cable 500 can be removed such that each of the exposed signal conductor ends 514*a-b* extend out, such as forward, from the inner and exterior insulative layers 504*a-b* and 510 and the ground jacket 506 along the longitudinal direction L. Alternatively, the plurality of cables 500 can be manufactured such that the respective signal carrying conductors 502 extend longitudinally outward from the inner and exterior insulative layers 504*a-b* and 510, so as to expose the signal conductor ends 514. Further, the plurality of cables 500 can be manufactured such that the respective signal carrying conductors 502 extend longitudinally outward from the ground jacket 506 at the end 512 of each cable 500. Additionally, the exterior insulative layer 510 can terminate at a location rearward with respect to the inner insulative layers 504*a-b*, such that an exposed portion 507 of the insulative layers 504*a-b* of each cable 500 extends forward with respect to the exterior insulation layer 510, and can terminate at a location between the exterior insulation layer 510 and the exposed signal conductor ends 514*a-b*. Alternatively, the plurality of cables 500 can be manufactured with at least a portion of the exterior insulation layer 510 removed so as to define the exposed portions 507 of the inner insulative layers 504*a-b*.

Each of the exposed ends 514*a* and 514*b* can be electrically connected to the leadframe assembly 430. For instance, the ends 514*a* and 514*b* of each cable 500 can attach to respective ones of the electrical signal contacts 452 so as to place the signal conductors 502*a* and 502*b* in electrical communication with the respective ones of the electrical signal contacts 452. For instance, the first and second end portions 514*a* and 514*b* can be attached, such as soldered or sonic welded, laser or resistance welded, to the respective ones of the electrical signal contacts 452, for instance at the respective mounting ends 458 or other location along the length of the electrical signal contacts 452. Alternatively, each of the end portions 514*a* and 514*b* can be configured to be mounted or otherwise attached to electrical contact pads of a substrate so as to place the cables 500 in electrical communication with the substrate. The electrical signal contacts 452 of the electrical connector 400 can then be mounted to the substrate such that the electrical signal contacts of the electrical connector are placed in electrical communication with respective ones of the cables signal conductors 502*a* and 502*b*.

Figure 6:
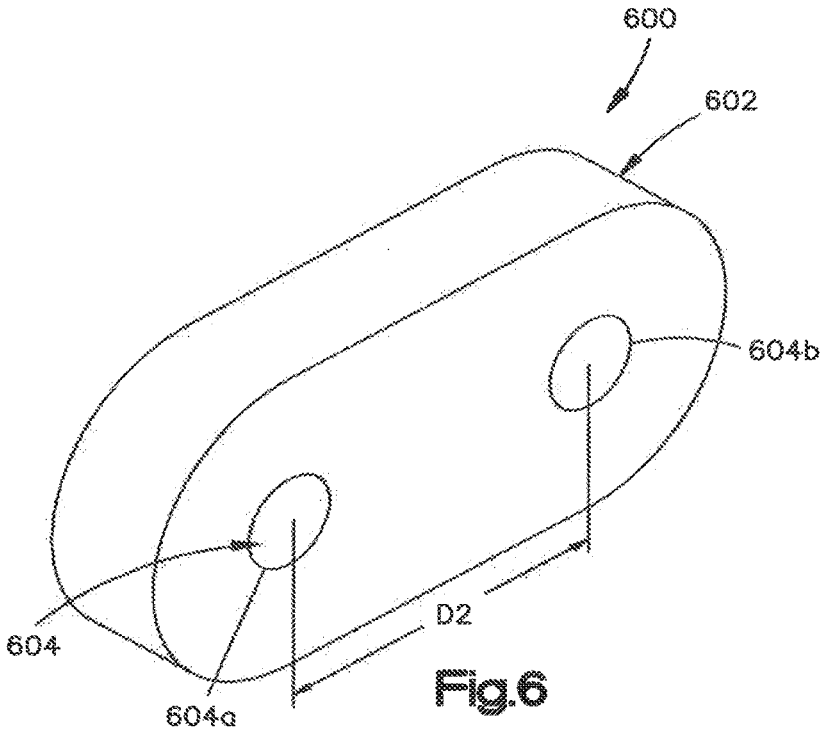
FIG. 6 is a perspective view of an interposer of the cable connector assembly.

Referring now also to FIG. 6, the electrical cable assembly 200 can include at least one interposer 600, such as a plurality of interposers 600, that are configured to receive and retain each of the first and second electrical signal conductors 502*a* and 502*b* of a respective one of the cables 500. The first and second electrical signal conductors 502*a* and 502*b* of at least one or more up to all of the cables 500 can define differential signal pairs. Each interposer 600 can include a dielectric or electrically insulative body 602 and at least one hole 604 that extends through the body 602. The at least one hole 604 is sized to receive a respective at least one of the pair of first and second differential signal conductors 502*a* and 502*b*, respectively, for instance at the respective at least one of the exposed ends 514*a* and 514*b*. In accordance with one embodiment, the interposer body 602 does not completely cover the at least one of the exposed ends 514*a* and 514*b*, such that the at least one of the exposed ends 514*a* and 514*b* extend into the corresponding at least one hole 604 at one end of the body 602, through the hole 604 and out an opposed end of the body 602. The at least one hole 604 can define a cross-sectional dimension, such as a diameter, that is sized substantially equal to or greater than the respective at least one of the exposed ends 514*a* and 514*b*.

The cross-sectional dimension of the at least one hole 604 can be sized less than that of the exterior insulation layer 510. For instance, the cross-sectional dimension of the at least one hole 604 can be measured along a select direction, and the exterior insulation layer 510 can likewise define a cross-sectional dimension along the select direction that is less than the cross-sectional dimension of the at least one hole 604. Accordingly, in accordance with one embodiment, the interposer 600 does not cover the exterior insulation that surrounds the respective at least one of the differential signal conductors 502*a* and 502*b*. The cross-sectional dimension of the at least one hole 604 can be sized less than the that of the respective at least one of the insulative layer 504*a* and 504*b*, such that the at least one hole 604 is sized to not receive the at least one of the inner insulation layers 504*a* and 504*b* that surrounds the respective at least one of the differential signal conductors 502*a* and 502*b*, and the interposer 600 does not cover the at least one of the inner insulation layers 504*a* and 504*b*. Alternatively, the cross-sectional dimension of the at least one hole 604 can be sized greater than the that of the respective at least one of the insulative layer 504*a* and 504*b*, such that the that the at least one hole 604 is sized to receive the at least one of the inner insulation layers 504*a* and 504*b* that surrounds the respective at least one of the differential signal conductors 502*a*, and the interposer 600 covers at least a length of the at least one of the exposed portions 507*a-b* of the at least one of the inner insulation layers 504*a* and 504*b*.

For instance, in accordance with one embodiment, each interposer 600 includes a first hole 604*a* and a second hole 604*b* that extend through the body 602. The first hole 604*a* is configured to receive the first signal conductor 502*a* of the differential pair of signal conductor, for example at the first exposed end portion 514*a*, and the second hole 604*b* is configured to receive the second signal conductor 502*b* of the differential pair of signal conductors, for instance at the second exposed end portion 514*b*. Thus, each of the pair of holes 604*a* and 604*b* can be sized to receive different ones of a pair of cable conductors 502*a* and 502*b*. In accordance with one embodiment, the interposer 600 does not completely cover the exposed ends 514*a* and 514*b* of the respective one of a pair of differential signal conductors 502*a-b*, and does not extend over the exterior insulation layer 510. The end portions 514*a* and 514*b* can attach to the leadframe assembly 430 in the manner described above at respective attachment locations, such that the interposer 600 is captured between the attachment locations and the exterior insulation layer 510. Each of the pair of holes 604*a* and 604*b* can be dimensioned greater than or less than the inner insulation layers 504*a* and 504*b* in the manner described above. In accordance with one embodiment, each interposer includes only a pair of holes 604*a* and 604*b*. Each of the holes 604*a* and 604*b* can be fully encircled, and thus closed, by the body 602 along at least a portion up to all of their length along the longitudinal direction L. The body 602 can be a single monolithic body that defines the holes 604*a* and 604*b*. Each of the pair of holes 604*a* and 604*b* can further be dimensioned the same as the other of the pair of holes 604*a* and 604*b*. Further, the first and second holes 604*a* and 604*b* can be oriented parallel to each other through the electrically insulative body 602 of the interposer 600.

As illustrated in FIG. 6, each of the pair of holes 604*a* and 604*b* is spaced apart from the other of the pair of holes 604*a* and 604*b* a distance D2 substantially equal to a distance that contact pads of the first electrical connector 500 are spaced, such that the cable conductors 502*a* and 502*b* that extend through the respective holes 604*a* and 604*b* are aligned with respective ones of the contact pads. The contact pads can be defined by respective ones of adjacent signal contacts 452, or can be defined by a substrate, such as a printed circuit board, that is in electrical communication with the respective ones of adjacent signal contacts 452. The end portions 514*a* and 514*b* that extend through the respective first and second holes 604*a* and 604*b* are mounted to the contact pads so as to attach the signal conductors 502*a* and 502*b* to the leadframe assembly 430 in the manner described above. In accordance with the illustrated embodiment, the center of each of the first and second holes 604*a* and 604*b* can be spaced from the center of the other of the first and second holes 604*a* and 604*b* the second distance D2 that can be equal to the first distance D1 defined by the electrical cable 500, whether the electrical cable 500 has a single drain wire 508 or a pair of drain wires 508*a* and 508*b*. Alternatively, the second distance D2 can be less than the first distance D1 of the electrical cable 500, whether the electrical cable 400 has a single drain wire 508 or a pair of drain wires 508*a* and 508*b*. Alternatively, the second distance D2 can be greater than the first distance D1 of the electrical cable 500, whether the electrical cable 400 has a single drain wire 508 or a pair of drain wires 508*a* and 508*b*.

The body 602, and thus the interposer 600, and thus each of the first and second holes 604*a-b*, can have a depth along the longitudinal direction L from a first and of the interposer 600 to an opposed second end of the interposer 600 that is less than a distance that the exposed portions 514*a* and 514*b* extend out from either or both of the respective first and second electrically insulative layers 504*a* and 504*b*, and the exterior electrically insulative layer 510. The holes 604*a* and 604*b* each extend from the first end through the second end along the longitudinal direction L. The depth can, for instance, be between 0.5 mm and 2 mm, such as approximately 0.75 mm and approximately 1 mm. Accordingly, the interposer 600 only partially covers the exposed stripped portion of the respective one of the pair of differential signal conductors 502*a* and 502*b*, and a portion of the exposed portion 514*a* and 514*b* extends beyond the first end of the interposer 600. In accordance with one embodiment, the interposer 600 does not cover any conductive foil 506 of the electrical cable 500 that might extend forward from the external insulative layer 510. It should be appreciated that the depth of the body 602, and thus the interposer 600, can be selected to control the length of the exposed ends 514*a* and 514*b* along the longitudinal direction L, and a thickness of the body 602, and thus the interposer 600, along a direction perpendicular to the longitudinal direction L can also be selected to control a volume of the dielectric interposer body 602 that surrounds the exposed ends 514*a* and 514*b*.

The body 602, and thus the interposer 600, can have any suitable dielectric constant as desired, such as a dielectric constant that is greater or less than the dielectric constant of one or both of the electrically insulative layers 504 and the outer insulative layer 510. For instance, the interposer can have a dielectric constant between approximately 2 and approximately 5, for instance between approximately 2 and approximately 3, such as approximately 2.2, approximately 2.4, and approximately 2.7, or any suitable dielectric constant as desired. Without being bound by theory, it is believed that the interposer 600 reduces electrical signal reflections and helps to prevent electrical shorting between each of the pair of differential signal conductors 502*a* and 502*b*. The interposer 600 can receive the first and second signal conductors 502*a* and 502*b* prior to attaching the signal conductors 502*a* and 502*b* to the contact pads of the first electrical connector 400. In accordance with one embodiment, it has been found that one or more up to all of the dielectric constant of the interposer body 602, and thus the interposer 600, the depth of the body 602, and thus the interposer 600, and the thickness of the body 602, and thus the interposer 600, can be selected so as to determine the impedance of the electrical cable assembly 200.

Accordingly, a method of tuning the impedance of the electrical cable assembly 200 can include the steps of placing a first dielectric material, such as the interposer 600, having a dielectric constant greater than air, and thus greater than 1. The impedance of the electrical cable assembly 200 can be increased by reducing the thickness of the interposer body 602, reducing the depth of the interposer body 602, and/or reducing the dielectric constant of the interposer body 602, and can be decreased by providing an increased volumes of the first material in the space. The impedance of the electrical cable assembly 200 can be decreased by increasing the thickness of the interposer body 602, increasing the depth of the interposer body 602, and/or increasing the dielectric constant of the interposer body 602. It should be appreciated that a desired impedance level can be achieved without increasing the distance between the cables 500 along the lateral direction A, and thus without increasing the footprint of the electrical cable assembly 200. In accordance with one embodiment, the impedance of the electrical cable assembly 200 can be approximately 85 ohms. Thus, the method of tuning can include the steps of 1) inserting each of a pair of differential signal conductors 502*a-b* through respective different ones of the pair of holes 604*a-b* that extend through an electrically insulative body 602 of an interposer 600, the interposer body 602 defining a dielectric constant greater than air, 2) selecting a volume of the interposer body 602 that surrounds the pair of differential signal conductors 602*a-b* so as to correspondingly adjust a dielectric constant in a space between the pair of differential signal conductors 602*a-b* and a second immediately adjacent pair of electrical signal conductors 602*a-b* of a second electrical cable 500, and 3) placing each of the pair of differential signal conductors 602*a-b* that extend through the holes 604 in electrical communication with respective ones of the differential signal contacts 452.

Referring again to FIGS. 1-6 generally, the signal contacts 452 define respective mating ends 456 that extend along the mating interface 402, and mounting ends 458 that extend along the mounting interface 404. The signal contacts 452 can be constructed as vertical contacts, whereby the mating ends 456 and the mounting ends 458 are oriented substantially parallel to each other. Each signal contact 452 can define a pair of opposed broadsides 460 and a pair of opposed edges 462 that extend between the opposed broadsides 460. The opposed edges 462 can be spaced apart the first distance D1. The mating end 456 of each signal contact 452 can be constructed as a receptacle mating end that defines a curved tip 464. The signal contacts 452 can be arranged in pairs 466, which can define edge-coupled differential signal pairs. Any suitable dielectric material, such as air or plastic, may be used to isolate the signal contacts 452 from one another. The mounting ends 458 can be provided as cable conductor mounting ends, each mounting end 458 configured to receive a signal conductor end 514 of a respective one of the plurality of cables 500. The first substrate 300*a* can be provided as a backplane electrical component, midplane electrical component, daughter card electrical component, or the like. In this regard, the electrical connector assembly 20 can be provided as a backplane electrical connector assembly.

Because the mating interface 402 is oriented substantially parallel to the mounting interface 404, the first electrical connector 400 can be referred to as a vertical connector, though it should be appreciated that the first electrical connector 400 can be constructed in accordance with any desired configuration so as to electrically connect a third complementary electrical component, such as a complementary electrical component electrically connected to opposed ends of the plurality of cables 500, to the first electrical connector 100, and thereby to a first complementary electrical component, such as the first substrate 300*a*. For instance, the first electrical connector 400 can be constructed as a vertical or mezzanine connector or a right-angle connector as desired.

The ground plate 468 includes a plate body 470 and a plurality of ground mating ends 472 that extend forward from the plate body 470 along the longitudinal direction L. The ground mating ends 472 are aligned along the transverse direction T. Each ground mating end 472 can define a pair of opposed broadsides 476 and a pair of opposed edges 478 that extend between the opposed broadsides 476. The opposed edges 478 can be spaced apart the second distance D2 along the transverse direction T. Each ground mating end 472 can be constructed as a receptacle ground mating end that defines a curved tip 480. At least one, such as each ground mating end 472 can define an aperture 482 that extends through the ground mating end 472 along the lateral direction A. The apertures 482 can be sized and shaped so as to control the amount of normal force exerted by the ground mating ends 472 on a complementary electrical contact of a complementary electrical connector, for instance the ground mating ends 172 of the first electrical connector 100. The apertures 482 of the illustrated embodiment are constructed as slots having rounded ends that are elongate in the longitudinal direction L. However it should be appreciated that the ground mating ends 472 can be alternatively constructed with any other suitable aperture geometry as desired.

The electrical contacts 450 can be arranged such that adjacent ones of the electrical signal contacts 452 can define pairs such as differential signal pairs. The electrical contacts 450, including the mating ends 456 and ground mating ends 472 can define any repeating contact pattern as in each of the desired along the linear array, including S-S-G, G-S-S, S-G-S, or any suitable alternative contact pattern, where "S" represents an electrical signal and "G" represents a ground. Furthermore, the electrical contacts 450 of the leadframe assemblies 430 that are adjacent each other along the row direction, such as the lateral direction A, can define different contact patterns. In accordance with one embodiment, the leadframe assemblies 430 can be arranged pairs of first and second leadframe assemblies 430, respectively that are adjacent each other along the row direction. The electrical contacts 450 of the first leadframe assemblies are arranged along first linear arrays at the mating ends. The electrical contacts 450 of the second leadframe assemblies are arranged along second linear arrays at the mating ends. The first leadframe assembly can define a first contact pattern in the first direction, and the second leadframe assembly can define a second contact pattern in the first direction that is different than the first contact pattern of the first leadframe assembly.

The plate body 470 defines a first plate body surface that can define and inner surface 470*a* and an opposed second plate body surface that can define a second or outer surface 470*b* of the body of the ground plate 468. The outer surface 270*b* is spaced from the inner surface 470*a*, along the lateral direction A. The inner surface 470*a* faces the plurality of cables 500 when the ground plate 468 is attached to the leadframe housing 432. The ground plate 468 can further include opposed first and second side walls 467 and 469 that are spaced apart from each other along the transverse direction T such that the leadframe housing 432 can be received between the first and second side walls 467 and 469 in an interference fit, for example by pressing the leadframe housing 432 toward the ground plate 468 such that the leadframe housing 432 snaps into place between the first and second side walls 467 and 469. Each of the first and second side walls 467 and 469 can include a wing 471 that extends outwardly from the ground plate 468 along the transverse direction T, the wings 471 configured to be supported by the connector housing 406 when the leadframe assembly is inserted into the connector housing 406. The ground plate 468 can be formed from any suitable electrically conductive material, such as a metal.

Because the mating ends 456 of the signal contacts 452 and the ground mating ends 472 of the ground plate 468 are provided as receptacle mating ends and receptacle ground mating ends, respectively, the first electrical connector 400 can be referred to as a receptacle connector as illustrated. In accordance with the illustrated embodiment, each leadframe assembly 430 can include a ground plate 468 that defines five ground mating ends 472 and nine signal contacts 452.

The nine signal contacts 452 can include four pairs 466 of signal contacts 452 configured as edge-coupled differential signal pairs, with the ninth signal contact 452 reserved. The ground mating ends 472 and the mating ends 456 of the signal contacts 452 of each leadframe assembly 430 can be arranged in a column that extends along the column direction. The differential signal pairs can be disposed between successive ground mating ends 472, and the ninth signal contact 452 can be disposed adjacent one of the ground mating ends 472 at the end of the column.

Each of the plurality of leadframe assemblies 430 can include a plurality of first leadframe assemblies 430 provided in accordance with a first configuration and a plurality of second leadframe assemblies 430 provided in accordance with a second configuration. In accordance with the first configuration, the ninth signal contact 452 of the first leadframe assembly 430 is disposed at an upper end of the column of electrical contacts 450. In accordance with the second configuration, the ninth signal contact 452 of the second leadframe assembly 430 is disposed at a lower end of the column of electrical contacts 450. It should be appreciated that the respective leadframe housings 432 of the first and second leadframe assemblies 430 can be constructed substantially similarly but with structural differences accounting for the respective configurations of electrical contacts 450 within the first and second leadframe assemblies 430 and for the configurations of the respective ground plates 468. It should further be appreciated the illustrated ground plate 468 is configured for use with the first leadframe assembly 430, and that the ground plate 468 configured for use with the second leadframe assembly 430 may define the ground mating ends 472 at locations along the plate body 470 that are different from those of the ground plate 468 configured for use with the first leadframe assembly 430.

The compression shield 490 can be configured to be attached to the leadframe housing 432 so as to compress exposed portions of the ground jackets 506 of the cables 500 into contact with the ground plate 468. The compression shield 490 can further be configured to isolate each cable 500 from each other cable 500 of the plurality of cables 500. The compression shield 490 can include a shield body 492 that defines an outer end 492*a* and an inner end 492*b* that is spaced from the outer end 492*a* along the transverse direction T, and opposed first and second sides 492*c* and 492*d* that are spaced apart from each other along the transverse direction T. The compression shield 490 is configured to be attached to the leadframe housing 432 such that the inner end 492*b* is spaced closer to the ground plate 468 than the outer end 492*a*. The inner end 492*b* of the shield body 492 can face the ground plate 468 when the compression shield 490 is attached to the leadframe housing 432. In accordance with the illustrated embodiment, the inner end 492*b* of at least a portion of the shield body 492 can abut the ground plate 468 when the compression shield 490 is attached to the leadframe housing 432.

The shield body 492 of each compression shield 490 can define a plurality of substantially "U" shaped canopies 494 that are spaced apart from each other along the transverse direction T. Each canopy 494 is configured to receive and isolate an end 512 of a respective one of the cables 500 from the respective ends 512 of other ones of the plurality of cables 500 that are disposed in respective adjacent ones of the cavities 504, for instance to reduce electrical cross talk between the cables 500 when the cables 500 carry data signals. In accordance with the illustrated embodiment, each canopy 494 includes a top wall 497 that is spaced from the inner end 492*b* along the lateral direction A, and opposed first and second side walls 493 and 495 that are spaced apart from each other along the transverse direction T. The compression shield 490 can include attachment members 498 that are configured to be attached to the first and second attachment arm 438 and 440 of the leadframe housing 432. The attachment members 498 can be disposed at the first and second sides 492*c* and 492*d* of the shield body 492. The attachment members 498 can be shaped the same or differently.

Each of the canopies 494 is configured to receive at least one of the plurality of cables 500. The For instance, each of the canopies 494 can receive only a single cable 500 when the compression shield 490 is attached to the leadframe housing 432. It should be appreciated that the illustrated compression shield 490 is configured for use with the first leadframe assembly 430, and that the compression shield 490 configured for use with the second leadframe assembly 430 may define the canopies 494 at locations along the shield body 492 that are different from those of the compression shield 490 configured for use with the first leadframe assembly 430 as described herein, so as to confirm with the contact pattern, and that the attachment members 498 of the compression shields 490 for use with the first and second leadframe assemblies 430 as described herein can be configured in accordance with any alternative embodiment as desired.

In accordance with a preferred method of assembling the leadframe assembly 430, the leadframe housing 432, including the signal contacts 452, can be attached to the ground plate 468 as described above. The plurality of cables 500 can then be prepared, for example by removing portions of one or both of the inner insulative and exterior insulation layers 504*a-b* and 510 to define the conductor ends 514 and the exposed portions 507 of the ground jackets 506. The conductor ends 514 can be configured to be disposed onto respective ones of the mounting ends 458 of the signal contacts 452. The exposed portion 507 of the ground jacket 506 of each cable 500 can be configured to overlap with the inner surface 470*a* of the plate body 470, and can abut the inner surface 470*a* of the plate body 470 when the conductor end 514 of each cable 500 is attached to a corresponding one of the mounting ends 458 of the signal contacts 452.

The conductor ends 514 of each of the plurality of cables 500 can then be attached to respective ones of the mounting ends 458 of the signal contacts 452. For example, the conductor ends 514 of each of the plurality of cables 500 can be soldered, or otherwise attached to respective ones of the mounting ends 458 of the signal contacts 452. The compression shield 490 can then be attached to leadframe assembly 430. The compression shield 490 operates to compress at least the ends 512 of the plurality of cables 500 as the compression shield 490 is attached to the leadframe assembly 430.

As the compression shield 490 is attached to the leadframe housing 432, the inner surface 497*a* of the top wall 497 comes into contact with cables 500, thereby compressing the cables such that the exposed portions 507 of the ground jackets 506 of each of the cables 500 are compressed against the inner surface 470*a* of the plate body 470. The compression shield 490 can thus be configured to bias at least a portion of each of the plurality of cables 500, for instance the exposed portions 507 of the ground jackets 506, against respective portions of the ground plate 468, such that the exposed portions 507 of the ground jackets 506 are placed into electrical communication with the ground plate 468. It should be appreciated that the compression shield 490 can be constructed of any suitable material as desired. For instance, the compression shield 490 can be made from a conductive material such as a metal or a conductive plastic, or any suitable lossy material as desired, such as a conductive lossy material. It should be appreciated the first electrical connector 400 is not limited to the illustrated leadframe assembly 430. For example, the electrical connector 400 can be alternatively constructed using any other suitable leadframe assembly, for instance one or more leadframe assemblies constructed as desired. It should be appreciated that the compression shield 490 has been described above in accordance with one example only, and that the compression shield 490 can be constructed in accordance with any suitable alternative embodiment as desired so as to compress exposed portions of the ground jackets 506 of the cables 500 into contact with the ground plate 468.

The connector housing 406 can be constructed as a vertical connector housing or a right-angle connector housing. The first electrical connector 400 can include a plurality of leadframe assemblies 430 that are disposed into the void of the connector housing 406 and are spaced apart from each other along the lateral direction A. Each leadframe assembly 430 can define a respective column of electrical contacts 450 in the electrical connector 400. In accordance with the illustrated embodiment, the connector housing 406 supports six leadframe assemblies 430. The six leadframe assemblies 430 can include alternating first and second leadframe assemblies 430 disposed from left to right in the connector housing 406. The tips 464 of the mating ends 456 of the signal contacts 452 and the tips 480 of the ground mating ends 472 of the ground plate 468 of the first leadframe assembly can be arranged in accordance with a first orientation wherein the tips 464 and 480 are curved toward the first side wall 408*e* of the housing body 408. The tips 464 of the mating ends 456 of the signal contacts 452 and the tips 480 of the ground mating ends 472 of the ground plate 468 of the second leadframe assembly can be arranged in accordance with a second orientation wherein the tips 464 and 480 are curved toward the second side wall 408*f* of the housing body 408. The first electrical connector 400 can be constructed with alternating first and second leadframe assemblies 430 disposed in the connector housing 406 from left to right between the first side wall 408*e* and the second side wall 408*f*.

The first and second connector housings 106 and 406 can further define complementary retention members that are configured to retain the first and second electrical connectors 100 and 400 in a mated position with respect to each other. For example, in accordance with the illustrated embodiment, the connector housing 106 further defines at least one latch receiving member 123, such as first and second latch receiving members 123*a* and 123*b* that extend into the first and second alignment beams 122*a* and 122*b*, respectively, along the transverse direction T. The connector housing 406 further includes at least one latch member 423, such as first and second latch members 423*a* and 423*b*. The first latch member 423*a* is disposed on the top wall 408*c* of the housing body 408, and is configured to releasably engage with the first latch receiving member 123*a*. The second latch member 423*b* is similarly constructed to the first latch member 423*a*, is disposed on the bottom wall 408*d* of the housing body 408, and is configured to releasably engage with the second latch receiving member 123*b*.

The housing body 408 can further be configured to protect the first and second latch members 423*a* and 423*b*. For example, in accordance with the illustrated embodiment, the first and second side walls 408*e* and 408*f* are extended above the top wall 408*c* along the transverse direction T, and are extended below the bottom wall 408*d* along the transverse direction T. It should be appreciated that the first and second connector housings 106 and 406 are not limited to the illustrated retention members, and that one or both of the first and second connector housings 106 and 406 can be alternatively constructed with any other suitable retention members as desired. It should further be appreciated that the second connector housing 206 can be alternatively constructed in accordance with the illustrated retention members or with any other suitable retention members as desired.

The second electrical connector 100 can include a dielectric, or electrically insulative connector housing 106 and a plurality of electrical contacts 150 that are supported by the connector housing 106. The plurality of electrical contacts 150 can be referred to as a first plurality of electrical contacts with respect to the electrical cable connector system 10. The plurality of electrical contacts 150 can include a first plurality of signal contacts 152 that each defines a mating end at the mating interface 102, and a mounting end at the mounting interface 104. The electrical contacts 150 can further include a plurality of ground mating ends at the mating interface 102 and ground mounting ends at the mounting interface 104. The mating ends of the signal contacts 152 can be aligned with the ground mating ends alone a transverse direction T that is substantially perpendicular to the longitudinal direction L. The ground ends of the signal contacts 152 can be aligned with the ground mating ends along the transverse direction T when the second electrical connector 100 is a vertical connector, and alone the longitudinal direction L when the second electrical connector 100 is a right-angle connector. The electrical contacts 150 can be arranged in a plurality of linear arrays that are spaced from each other along the lateral direction A. In accordance with one embodiment, each linear array includes a ground plate that includes a conductive plate body such that the ground mating ends and the ground mounting ends extend out from the plate body. Alternatively, the electrical contacts 150 can include a plurality of ground contacts that are spaced from each other, each including a single mating end and a single mounting end.

The foregoing description is provided for the purpose of explanation and is not to be construed as limiting the electrical connector. While various embodiments have been described with reference to preferred embodiments or preferred methods, it is understood that the words which have been used herein are words of description and illustration, rather than words of limitation. Furthermore, although the embodiments have been described herein with reference to particular structure, methods, and embodiments, the electrical connector is not intended to be limited to the particulars disclosed herein. For instance, it should be appreciated that structure and methods described in association with one embodiment are equally applicable to all other embodiments described herein unless otherwise indicated. Those skilled in the relevant art, having the benefit of the teachings of this specification, may effect numerous modifications to the electrical connector as described herein, and changes may be made without departing from the spirit and scope of the electrical connector, for instance as set forth by the appended claims.

What is claimed is:

1. An electrical cable assembly comprising:

an electrical cable comprising a pair of differential signal conductors, the signal conductors comprising an insulated portion and an un-insulated portion; and an interposer comprising:

an electrically insulative body that defines a pair of holes that extend through the body, wherein:

each hole of the pair of holes receives a respective un-insulated portion of a signal conductor of a pair of the plurality of pairs of differential signal conductors, and the insulative body of the interposer is aligned with insulation forming insulated portions of the pair of differential signal conductors.

2. The electrical cable assembly as recited in claim 1, wherein each of the pair of holes is sized to receive different ones of the pair of signal conductors.

3. The electrical cable assembly as recited in claim 1, wherein each of the pair of holes is spaced apart from the other a distance substantially equal to a distance that contacts of the electrical connector are spaced, such that the cable conductors that extend through the respective holes are aligned with respective ones of the contacts.

4. The electrical cable assembly as recited in claim 1, wherein the interposer has a dielectric constant between 2 and 5.

5. The electrical cable assembly as recited in claim 1, wherein the holes extend through the body along a longitudinal direction, and the body defines a depth along the longitudinal direction, wherein the depth is between 0.5 mm and 2 mm.

6. An electrical cable assembly comprising:

an electrical cable comprising a plurality of pairs of differential signal conductors; and a cable connector at which the differential signal conductors are electrically connected to contacts, the connector comprising a plurality of interposers, each interposer comprising an electrically insulative body that defines a pair of holes that extend through the electrically insulative body, each hole of the pair configured to receive a respective conductor of a pair of the plurality of pairs of differential signal conductors.

7. The electrical cable assembly of claim 6, wherein the plurality of interposers do not receive exposed conductive foil of the electrical cable.

8. The electrical cable assembly of claim 6, wherein each interposer of the plurality of interposers only partially covers an exposed stripped portion of the respective one of the pair of the plurality of pairs of differential signal conductors and a portion of the exposed stripped portion extends beyond a first end of the interposer.

9. The electrical cable assembly of claim 6, wherein the plurality of interposers have a dielectric constant different than the dielectric constant of the exterior insulation.

10. The electrical cable assembly of claim 6, wherein the connector further comprises a compression shield having a plurality of U-shaped canopies, and each canopy receives and isolates an end of a pair of the plurality of pairs of differential signal conductors.

11. The electrical cable assembly of claim 10, wherein an exterior insulation surrounds both of the first and second ones of the pair of differential signal conductors.

12. The electrical cable assembly of claim 10, wherein an exterior insulation surrounds only one of the first and second ones of the pair of differential signal conductors, and not the other of the first and second ones of the pair of differential signal conductors.

13. The electrical cable assembly of claim 6, further comprising:

an electrical connector having a plurality of leadframe assemblies each including a plurality of electrical signal contacts having mating ends, and an electrically conductive ground plate that defines a plurality of ground mating ends aligned with the mating ends of the signal contacts, wherein the electrical cable defines at least one drain coupled to the ground plate, and the signal conductors are in electrical communication with respective first and second electrical signal contacts of one of the leadframe assemblies.

14. The electrical cable assembly of claim 6, wherein each hole of the plurality of pairs of holes is sized less than those of respective inner insulation layers that surround the respective ones of the plurality of pairs of differential signal conductors.

15. The electrical cable assembly of claim 6, wherein each hole of the plurality of pairs of holes is sized greater than those of respective inner insulation layers that surround the respective ones of the plurality of pairs of differential signal conductors.

16. The electrical cable assembly of claim 13, comprising:

an electrical cable comprising a pair of differential signal conductors; and an interposer comprising an electrically insulative body that defines a pair of holes, wherein each of the holes is configured to receive a respective one of the pair of differential signal conductors, wherein the electrical connector further comprises a compression shield attached to the leadframe so as to compress exposed portions of ground jackets of the electrical cable into contact with the ground plate, and the interposer is positioned between the compression shield and the ground plate.

17. An electrical cable assembly comprising:

an electrical cable comprising a pair of differential signal conductors;

an interposer comprising an electrically insulative body that defines a pair of holes, wherein each of the holes is configured to receive a respective one of the pair of differential signal conductors;

an electrical connector having a plurality of leadframe assemblies each including a plurality of electrical signal contacts having mating ends, and an electrically conductive ground plate that defines a plurality of ground mating ends aligned with the mating ends of the signal contacts, wherein the electrical cable comprises at least one drain coupled to the ground plate, and the signal conductors are in electrical communication with respective first and second electrical signal contacts of one of the leadframe assemblies.

18. A method of tuning an electrical characteristic of an electrical cable assembly that includes an electrical cable including a plurality of pairs of differential signal conductors, and a cable connector including a plurality of pairs of differential signal contacts, the method comprising the steps of:

inserting each of one of the plurality of pairs of differential signal conductors through respective different ones of a pair of holes of a plurality of pairs of holes that extend through at least one electrically insulative body of an interposer, the at least one interposer body having a dielectric constant and a volume so as to tune the impedance of the electrical cable assembly to a desired impedance level; and placing each of the plurality of pairs of differential signal conductors that extend through the holes in electrical communication with respective ones of the differential signal contacts.

19. The method of claim 18, wherein the placing step further comprises physically mounting each of the plurality of pairs of differential signal conductors that extend through the holes to the respective ones of the differential signal contacts.

20. The method of claim 18, further comprising:

compressing exposed portions of ground jackets of the cable into contact with a ground plate of the connector using a compression shield of the connector;

wherein the inteposer is positioned between the compression shield and the ground plate.

* * * * *